US010563446B2

(12) United States Patent
Tehranchi

(10) Patent No.: US 10,563,446 B2
(45) Date of Patent: Feb. 18, 2020

(54) MOVABLE BARRIER OPERATOR WITH REMOVABLE POWER SUPPLY MODULE

(71) Applicant: VIKING ACCESS SYSTEMS, LLC, Irvine, CA (US)

(72) Inventor: Ali Tehranchi, Irvine, CA (US)

(73) Assignee: FAAC International Inc., Rockledge, FL (US)

( * ) Notice: Subject to any disclaimer, the term of this patent is extended or adjusted under 35 U.S.C. 154(b) by 53 days.

(21) Appl. No.: 15/863,437

(22) Filed: Jan. 5, 2018

(65) Prior Publication Data

US 2018/0128033 A1 May 10, 2018

Related U.S. Application Data

(63) Continuation of application No. 14/100,166, filed on Dec. 9, 2013, now Pat. No. 9,890,575.

(51) Int. Cl.

| | |
|---|---|
| ***E05D 15/06*** | (2006.01) |
| ***E05F 15/70*** | (2015.01) |
| ***E05F 15/603*** | (2015.01) |
| *E05F 15/73* | (2015.01) |

(52) U.S. Cl.
CPC ..... *E05F 15/70* (2015.01); *E05F 15/603* (2015.01); *E05F 15/73* (2015.01)

(58) Field of Classification Search
CPC ..... E05F 15/70; E05F 15/603; E05F 15/73
USPC ..... 49/199, 404, 360
See application file for complete search history.

(56) References Cited

U.S. PATENT DOCUMENTS

| | | | |
|---|---|---|---|
| 3,652,124 | A | 3/1972 | Tronville |
| 3,658,373 | A | 4/1972 | Elkow |
| 3,764,875 | A | 10/1973 | Harris |
| 3,799,115 | A | 3/1974 | Fullerton |
| 3,878,646 | A | 4/1975 | Crocker |
| 4,231,190 | A | 11/1980 | Tieben |
| 4,338,553 | A | 6/1982 | Scott, Jr. |
| 4,340,799 | A | 7/1982 | Ueda |
| 4,408,146 | A | 10/1983 | Beckerman |
| 4,420,703 | A | 12/1983 | Adam |
| 4,450,545 | A | 5/1984 | Kishi |
| 4,501,012 | A | 2/1985 | Kishi |
| 4,556,994 | A | 12/1985 | Kawasaki |
| 4,630,395 | A | 12/1986 | Nasatka |

(Continued)

FOREIGN PATENT DOCUMENTS

CA 2399926 A1 * 3/2003 ..... A63F 13/08

OTHER PUBLICATIONS www.konarka.com, website, Mar. 5, 2007.

(Continued)

*Primary Examiner* — Jerry E Redman
(74) *Attorney, Agent, or Firm* — Jafari Law Group, Inc.

(57) ABSTRACT

The invention relates to a movable barrier operator with a removable power supply module for supplying power to the operator from a remote location. The power supply module may be decoupled from a barrier operator frame or housing, and installed in a remote location; the operator may therefore be observed and diagnosed remotely via a user interface that includes status indicators. In an exemplary embodiment, the user interface comprises one or more LED indicators to provide a user with information pertaining to the power supply of the operator.

15 Claims, 4 Drawing Sheets

(56) References Cited

U.S. PATENT DOCUMENTS 4,673,848 A 6/1987 Hagiwara
4,684,853 A 8/1987 Coash
4,937,855 A 6/1990 McNab
4,986,331 A 1/1991 Henkenjohann
5,134,350 A 7/1992 Mahoney
5,299,678 A * 4/1994 Chang ..... E05F 15/668 192/141
5,278,480 A 11/1994 Murray
5,447,380 A * 9/1995 Colonel ..... B41J 2/325 346/145
5,706,399 A 1/1998 Bareis
5,744,896 A 4/1998 Kessinger, Jr.
5,869,940 A 2/1999 Parsadayan
5,929,580 A 7/1999 Mullet
6,021,607 A 2/2000 Angove
6,025,685 A 2/2000 Parsadayan
6,051,947 A 4/2000 Lhotak
6,078,249 A 6/2000 Slavik
6,092,338 A 7/2000 Crowner
6,108,977 A 8/2000 Payne
6,137,421 A 10/2000 Dykema
6,161,005 A 12/2000 Pinzon
6,218,956 B1 4/2001 Davis
6,229,276 B1 5/2001 Fitzgibbon
6,239,569 B1 5/2001 Fitzgibbon
6,257,303 B1 6/2001 Coubray
6,283,531 B1 9/2001 Tanigawa
6,293,828 B1 * 9/2001 Colver ..... H05K 7/1454 439/680
6,318,024 B1 * 11/2001 Krsnak ..... E05D 13/12 49/177
6,326,751 B1 12/2001 Mullet
6,414,454 B1 7/2002 Lhotak
6,525,659 B2 2/2003 Jaffe
6,532,038 B1 3/2003 Haring
6,605,910 B2 8/2003 Mullet
6,614,200 B2 9/2003 Fowler
6,618,993 B2 9/2003 Burke
6,624,400 B2 9/2003 Chun
6,788,386 B2 9/2004 Cox
6,832,076 B2 12/2004 Study
6,882,715 B2 4/2005 Horn
6,909,215 B2 6/2005 Bryant
6,933,843 B1 8/2005 Horn
6,935,000 B1 8/2005 Arnaud
6,966,147 B2 11/2005 Solowiej
6,998,977 B2 2/2006 Gregori
7,038,409 B1 5/2006 Mullet
7,040,605 B2 5/2006 Lappen
7,042,183 B2 5/2006 Fitzgibbon
7,057,547 B2 6/2006 Olmsted
7,062,879 B2 6/2006 Wenzl
7,064,505 B2 6/2006 Sato
7,116,072 B1 10/2006 Murray
7,132,813 B2 11/2006 Gregori
7,138,912 B2 11/2006 Fitzgibbon
7,170,248 B2 1/2007 Tsui
7,170,998 B2 1/2007 McLintock
7,194,412 B2 3/2007 Mays
7,197,278 B2 3/2007 Harwood
7,208,897 B2 4/2007 Hotto
7,226,041 B2 6/2007 Ledford
7,264,417 B1 9/2007 Nasatka
7,382,063 B2 * 6/2008 Mullet ..... E05F 15/00 307/64
7,436,141 B2 10/2008 Perez
7,598,703 B2 * 10/2009 Zhang ..... B60L 53/30 320/107
7,677,636 B2 3/2010 Bosse
7,678,048 B1 3/2010 Urbano
7,688,014 B2 3/2010 Tang
7,950,870 B1 5/2011 Thompson
8,176,684 B2 5/2012 Marchetto
8,495,834 B2 * 7/2013 Harlow ..... E05F 15/74 49/199
8,561,814 B2 * 10/2013 Elwany ..... H05K 7/20736 211/26
8,707,627 B2 * 4/2014 Murray ..... E05F 15/643 49/506
8,839,557 B2 * 9/2014 Sheldon ..... E05F 15/79 49/199
8,981,898 B2 3/2015 Sims
9,015,994 B2 * 4/2015 Lamb ..... E05F 15/77 49/199
9,188,324 B2 * 11/2015 Jelinek ..... F21V 31/005
9,392,724 B2 * 7/2016 Hafnor ..... H05K 7/1457
9,442,538 B1 * 9/2016 Chen ..... E05B 65/006
9,572,275 B2 * 2/2017 Kao ..... H05K 7/1487
9,708,845 B2 * 7/2017 Tehranchi ..... E05F 15/70
9,904,329 B2 * 2/2018 Sisler ..... G06F 1/183
2001/0052433 A1 * 12/2001 Harris ..... B60K 1/04 180/68.5
2002/0067245 A1 6/2002 Campbell
2002/0138779 A1 * 9/2002 Emberty ..... G06F 1/26 713/340
2003/0015889 A1 1/2003 Stolle
2003/0034750 A1 2/2003 Horn
2003/0102751 A1 6/2003 Bryant
2003/0150164 A1 8/2003 Mehalshick
2003/0197914 A1 10/2003 Cox
2004/0210327 A1 10/2004 Harwood
2004/0212335 A1 10/2004 Fitzgibbon
2004/0222913 A1 11/2004 Olmsted
2004/0239496 A1 12/2004 Fitzgibbon
2005/0034374 A1 2/2005 Ebbe
2005/0052080 A1 3/2005 Maslov
2005/0253710 A1 11/2005 Eskildsen
2005/0253731 A1 11/2005 Fitzgibbon
2005/0258934 A1 11/2005 Buck
2005/0263099 A1 12/2005 Gerig
2005/0288840 A1 12/2005 Suzuki
2006/0113935 A1 6/2006 Angiuli
2006/0197481 A1 9/2006 Hotto
2006/0213362 A1 9/2006 Heertjes
2006/0237150 A1 10/2006 Olmsted
2006/0250777 A1 * 11/2006 Chen ..... G06F 1/188 361/727
2006/0267409 A1 11/2006 Mullet
2007/0035074 A1 2/2007 Vervoordeldonk
2007/0052946 A1 3/2007 Heiland
2007/0093943 A1 4/2007 Nelson
2007/0146675 A1 7/2007 Butler
2007/0188724 A1 8/2007 Jacobs
2007/0222401 A1 9/2007 Trumper
2008/0061948 A1 3/2008 Perez
2008/0094186 A1 4/2008 Perez
2008/0106370 A1 * 5/2008 Perez ..... G10L 17/00 340/5.7
2008/0166914 A1 7/2008 Buzil
2008/0271859 A1 11/2008 Kourtesis
2009/0085719 A1 * 4/2009 Perez ..... G07C 9/00103 340/5.7
2009/0149999 A1 7/2009 Schramm
2009/0188166 A1 * 7/2009 Taheri ..... E06B 9/70 49/31
2009/0189560 A1 7/2009 Taheri
2009/0206777 A1 * 8/2009 Taheri ..... E05F 15/63 318/15
2009/0211160 A1 * 8/2009 Tehranchi ..... E05F 15/603 49/360
2009/0233460 A1 * 9/2009 Huang ..... H01R 31/06 439/65
2009/0268435 A1 * 10/2009 Mandy ..... F21S 8/02 362/147
2010/0071264 A1 3/2010 Faulkner
2010/0115853 A1 5/2010 Gebhart
2011/0087904 A1 4/2011 Lee
2011/0113689 A1 5/2011 Johnson
2011/0192356 A1 8/2011 Loosveld
2011/0226539 A1 * 9/2011 Huss ..... B60K 6/46 180/65.21

(56) References Cited

U.S. PATENT DOCUMENTS

| | | | | |
|---|---|---|---|---|
| 2012/0243160 | A1* | 9/2012 | Nguyen | G06F 1/181 361/679.08 |
| 2014/0259930 | A1* | 9/2014 | Gilliam | E01F 13/048 49/70 |
| 2015/0159416 | A1* | 6/2015 | Tehranchi | E05F 15/603 49/31 |
| 2017/0285696 | A1* | 10/2017 | Magnusson | G06F 1/183 |
| 2018/0059185 | A1* | 3/2018 | Martin | G01R 31/3274 |

OTHER PUBLICATIONS

Viking Access Systems, "Vehicle Gate Operator Q-4" Feb. 2007; Regrieved from Internet <http://web.archive.org/web/20070630124920//http://vikingaccess.com/Q4.html> p. 1.

www.x10.com, On-line Catalog, Oct. 3, 2006, http://www.x10.con/homepage.htm.

http://www.niceforyou.com/english/hew-events/news-archives/niceopera-the-wireless-system-for-remote-control-of-automations.html, Mar. 14, 2008.

* cited by examiner

MOVABLE BARRIER OPERATOR WITH REMOVABLE POWER SUPPLY MODULE

PRIORITY AND CROSS-REFERENCE TO RELATED APPLICATIONS

The present application is a continuation of pending U.S. patent application Ser. No. 14/100,166, filed on Dec. 9, 2013, its disclosure incorporated herein by reference in its entirety.

TECHNICAL FIELD OF THE INVENTION

The present invention relates generally to a movable barrier operator with a removable power supply module, and more particularly, to a movable barrier operator that includes a removable power supply module for supplying power to the operator from a remote location.

COPYRIGHT & TRADEMARK NOTICE

A portion of the disclosure of this patent application may contain material that is subject to copyright protection. The owner has no objection to the facsimile reproduction by anyone of the patent documents or the patent disclosures, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

Movable barrier operators, such as gate operators, typically comprise a main control board, a battery, a gearbox, a motor, and a power supply box to power the operator, which controls the movable barrier. Typically, movable barrier operators require a high voltage power supply. In most cities, high voltage requires attaining a permit for running the corresponding cable or connection from a power source to the operator. Therefore, installing movable barrier operators often requires the additional expense of installing an underground line or cable that carries high voltage current from a source to the operator. This means that additional personnel (i.e. electricians) will be required. Furthermore, city permits will require payment for licenses and inspections to assure compliance with zoning laws. This presents the problem of added expense, inconvenience, and hassle to the user or service provider that installs the barrier operator.

Furthermore, when maintenance needs or technical problems arise regarding the operator's performance, a technician is often required. Typically, the technician will need to approach the operator itself to diagnose, for example, any power supply problems that may be causing the operator to malfunction. Often, a diagnostics check can identify typical problems and thus the technician typically performs diagnostics checks at the operator's physical location, such as near a gate. This is also time consuming and inconvenient for the technician.

Therefore, there is a need in the art for a way to supply power to a movable barrier operator without requiring expensive installation of high voltage power cables, and for performing diagnostics from a remote location, so as to facilitate operator installation and provide remote diagnostic maintenance capabilities. It is to these ends that the present invention has been developed.

SUMMARY OF THE INVENTION

To minimize the limitations in the prior art, and to minimize other limitations that will be apparent upon reading and understanding the present specification, the present invention describes a movable barrier operator with a removable power supply module. The power supply module further comprises a user interface for providing status indicators with the ability to display basic functional or diagnostic information pertaining to the operator.

A movable barrier operator, in accordance with an exemplary embodiment of the present invention, comprises: a motor; a gear box rotatably coupled to the motor, wherein the gear box is configured to move a barrier in response to activation of the motor; a controller configured to generate a control signal to control the activation of the motor; a frame mechanically supporting the motor, the gearbox, and the controller, wherein the frame comprises a bay including a first connector; and a removable power supply, comprising a second connector configured to mate with the first connector when the removable power supply is situated within the bay of the frame, and wherein the removable power supply is configured to supply power to the motor and controller through the mated first and second connectors.

Furthermore, the operator includes a cable comprising a third and fourth connector, wherein the third connector is configured to mate with the first connector of the bay of the frame, when the fourth connector is configured to connect to the second connector of the removable power supply when the removable power supply is not situated within the bay of the frame, and wherein the removable power supply is configured to supply power to the controller and the motor via the mated second and fourth connectors, the cable, and the mated first and third connectors. The removable power supply further comprises a user interface for providing a diagnostic status pertaining to the movable barrier operator.

It is an objective of the present invention to power a movable barrier operator, such as a gate operator, with a power supply module capable of powering the operator from a remote location.

It is another objective of the present invention to enable the power supply to be removed from the movable barrier operator from which it originates.

It is another objective of the present invention to allow for diagnostic information to be transmitted between the power supply and the main control board.

It is yet another objective of the present invention to display basic diagnostic information, such as the functionality of the power supply module's incoming power, outgoing power, and surge protection features.

It is yet another objective of the present invention to connect the power supply to the movable barrier operator in such a way that allows for usage of low voltage wiring.

Finally, it is yet another objective of the present invention to minimize or eliminate the need for procuring permits to install movable barrier operators, by providing low voltage wiring from a remote location.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 2(*b*) illustrates a block diagram of a movable barrier operator in accordance with one embodiment of the present invention, the block diagram depicting the operator components when configured with a remotely situated power supply module.

FIG. 3(*b*) is a perspective view of a removable power supply module, in accordance with an exemplary embodiment of the present invention, which includes a user interface comprising LED's to indicate a status of the operator.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

In the following detailed description, a movable barrier operator may be any system that controls a barrier to an entry, an exit, or a view. The barrier could be a door for a small entity (i.e. a person), or a gate for a large entity (i.e. a vehicle), which may swing out, slide open, or roll upwards. The operator, which moves the barrier from an open position to a closed position and vice-versa, may be manual or automatic and may be controlled locally or remotely.

Figure 1:
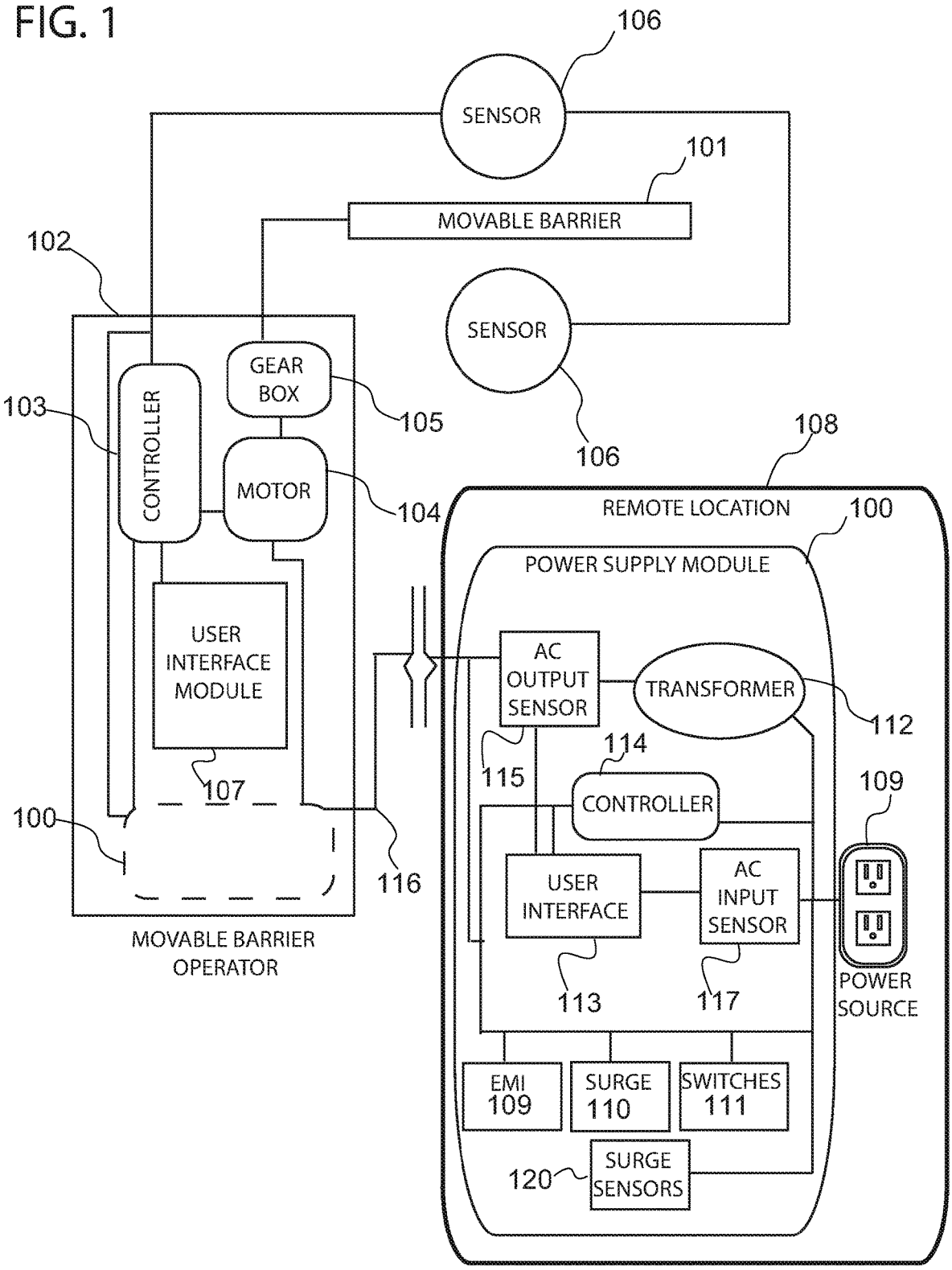
FIG. 1 illustrates a block diagram of a movable barrier operator in accordance with an exemplary embodiment of the present invention, wherein the power supply is located in a remote location.

FIG. 1 illustrates a block diagram of a movable barrier operator in accordance with an exemplary embodiment of the present invention, wherein the power supply is located in a remote location. More specifically, FIG. 1 depicts movable barrier (barrier 101) connected to movable barrier operator (operator 102), which controls movement of the barrier.

Operator 102 comprises controller 103, which is coupled to motor 104 and gear box 105. Also coupled to controller 103 are sensors 106, which may indicate controller 103 to activate motor 104 when, for example, a vehicle is approaching. When activated, either via a user input or activation from a sensor signal, controller sends a signal to motor 104, which in turn activates gear box 105, moving barrier 101 to, for example, a close or open position.

Typically, operator 103 includes user interface 107 for performing diagnostics or setting up control limits for barrier 101. In addition to the operator's main components, however, operator 102 further includes power supply module (module 100), which provides a novel advantage over operators found in the prior art. For example, while user interface 107 may be an LCD display that provides all diagnostic information pertaining to operator 102, by providing a power supply module that is able to be installed remotely, and that has diagnostic capabilities, all that information, or at least information pertaining to the operator's power supply, may be displayed remotely to a technician at remote location 108.

This is accomplished by configuring module 100 to be removable from within the operator's housing or frame, and be installed at a remote location to provide power to operator 102 via a low voltage power line or cable 116. In an exemplary embodiment, module 100 resides in remote location 108 and is connected to operator 102 via cable 116. Thus, module 100 is removable from operator 102.

Module 100 comprises several components including electromagnetic interference filters 109, surge protection filters 110, surge protection sensors, switches 111 (for switching between high voltage and low voltage outputs/inputs), surge protection sensors 120, and transformer 112 for supplying the low voltage current output to operator 102.

The components such as electromagnetic interference filters 109, surge protection filters 110, surge protection sensors, switches 111, surge protection sensors 120, and transformer 112, may be of any variety or type that is well known in the art. For example, transformer 112 is typically a toroidal transformer, however transformer 112 may be any other type of transformer suitable for changing a voltage level to operator 102; hence, any other similarly functioning device may be used, for example a switching regulator may be implemented instead of a transformer.

Additionally, in an exemplary embodiment, as shown in FIG. 1, module 100 further comprises user interface 113 and AC sensors 115 and 117 for providing a user with status indicators regarding the operator's power supply; signals from these sensors may include indication that there is no AC power—that AC power is low, that AC power is high, or that AC power is adequate. Similarly, signals and indicators may be communicated and displayed regarding a surge protection status via surge protection sensors. Furthermore, depending on the desired complexity and functionality of module 100, module 100 may further comprise controller 114 for communicating with operator 102.

User interface 113 may be any type of interface that communicates status or diagnostic information regarding the movable barrier operator. For example, user interface 113 may comprise LED indicators that provide information pertaining to module 100. Typically, user 107, which is inside a housing that covers operator 102, will display diagnostic information of all types that pertains to operator 102, including the information that may be provided via LED indicators in user interface 113. As explained above, having this additional user interface at a remote location, such as remote location 108, presents an advantage to users and technicians alike. In an exemplary embodiment, user interface 113 provides only information pertaining to the power supply module, or module 100, which is also communicated at user interface 107. In alternative embodiments, however, other diagnostic information may be communicated via user interface 113.

Cable 116 is typically a low voltage cable, such as but not limited to landscaping wire or direct current wire, which transmits voltages from module 100 to operator 102. At low voltage levels, module 100 may be safely removed from operator 102 and may then be relocated to remote location 108. Remote location 108 may be any remote location such as a guard hut, a maintenance shack, or any other convenient or appropriate location within a reasonable range of operator 102.

For example, and without limiting or deviating from the scope of the present invention, cable 116 may extend from module 100 to operator 102 via low voltage wire such as landscaping wire or a DC wire. This allows an installer or technician of operator 102 to circumvent the expensive wiring process that is typically involved in wiring a barrier operator that requires a high voltage power line such as a 120 volt or 220 volt line.

Cable 116 may comprise a single line or multiple lines that offer current in addition to data or signal communication. For example, and without limiting the scope of the present invention, cable 116 may provide operator 102 with low voltage power such as DC power in addition to providing a means for operator 102 to receive data or signals from module 100. Hence, in an exemplary embodiment of the present invention, module 100 is configured to provide power to operator 102, in addition to transmitting signals or data indicating a power supply status.

Furthermore, in one embodiment, operator 102 may also communicate with module 100 and transmit signals to module 100 indicating a status associated with operator 102. For example, operator 102 may send a signal relating to a maintenance requirement. Module 100 may receive this signal and display a status indication on user interface 113. This way, a user, for example a technician or service provider crew, may glean from module 100 the required maintenance information from remote location 108 without having to approach operator 102. This convenience allows for quick maintenance diagnostics from remote location 108 and circumvents having the technician to otherwise disable barrier 101 in order to provide any required maintenance checks.

Even if the module is locally installed rather than installed at location 108, module 100 is capable of informing a technician of important diagnostic information regarding module 100, and thus facilitating maintenance of operator 102. For example, and without limiting the scope of the present invention, module 100 may implement LEDs that alert technician regarding the module's voltage. In this way, the technician does not need to pull voltmeters to determine the status of the power source, since they may rely on the LED indicators. Naturally, this is also true when the power supply is remotely situated, since a technician viewing user interface 113 at remote location 108, would not need to take additional tools to access operator 102 to, for example, view the operator's power supply and voltage information.

In another embodiment, cable 116 may supply only an electrical low voltage current and a second cable may run alongside cable 116 to transmit diagnostic information from operator 102 to module 100.

As mentioned above, module 100 is typically installed in a remote location, although module 100 may also be housed within operator 102 if the premises in which operator 102 is installed permits easy installing and access. Typically however, module 100 is installed remotely. When installed remotely, for example at remote location 108, module 100 is configured to be plugged in to a regular electrical output such as power source 109, for example an AC outlet. Cable 116 is then connected via connectors (see FIG. 2(*a*) and FIG. 2(*b*)) between module 100 and operator 102.

At the time of installation and during regular maintenance, a technician or service provider crew may visit remote location 108 and provide quick maintenance diagnostic services without having to interfere with operation of operator 102. During installation, this means that operator 102 does not require city permits or complicated underground placement of high voltage power lines. During regular maintenance, this means the technician or service provider crew can simply approach remote location 108 and view the status displayed on user interface 113 of module 100 without intervening with, for example, vehicles that are entering or exiting the premises on which operator 102 is installed.

Figure 2A:
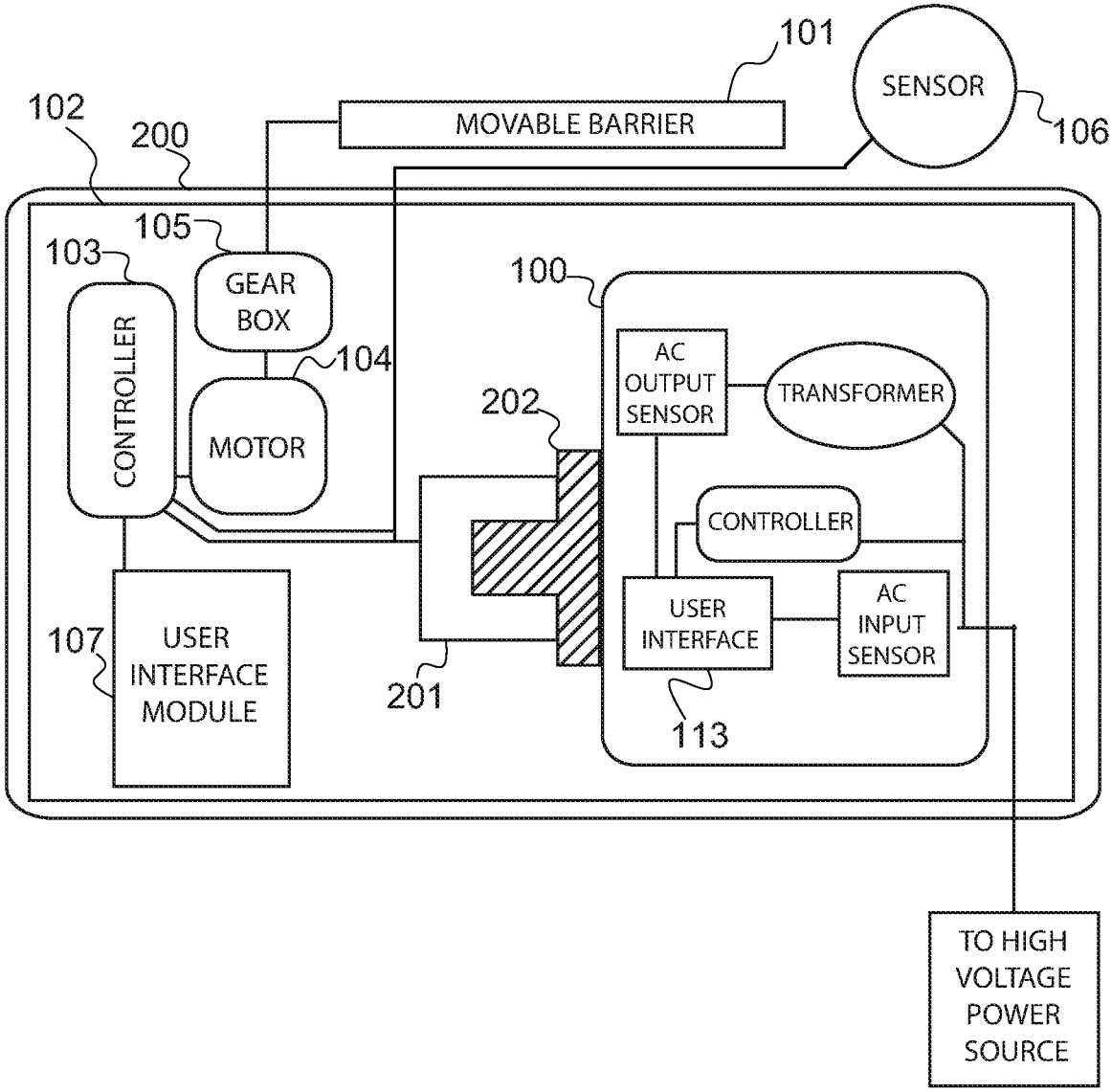
FIG. 2(*a*) illustrates a block diagram of a movable barrier operator in accordance with one embodiment of the present invention, the block diagram depicting the operator components when configured with a locally situated power supply module.
Figure 2B:
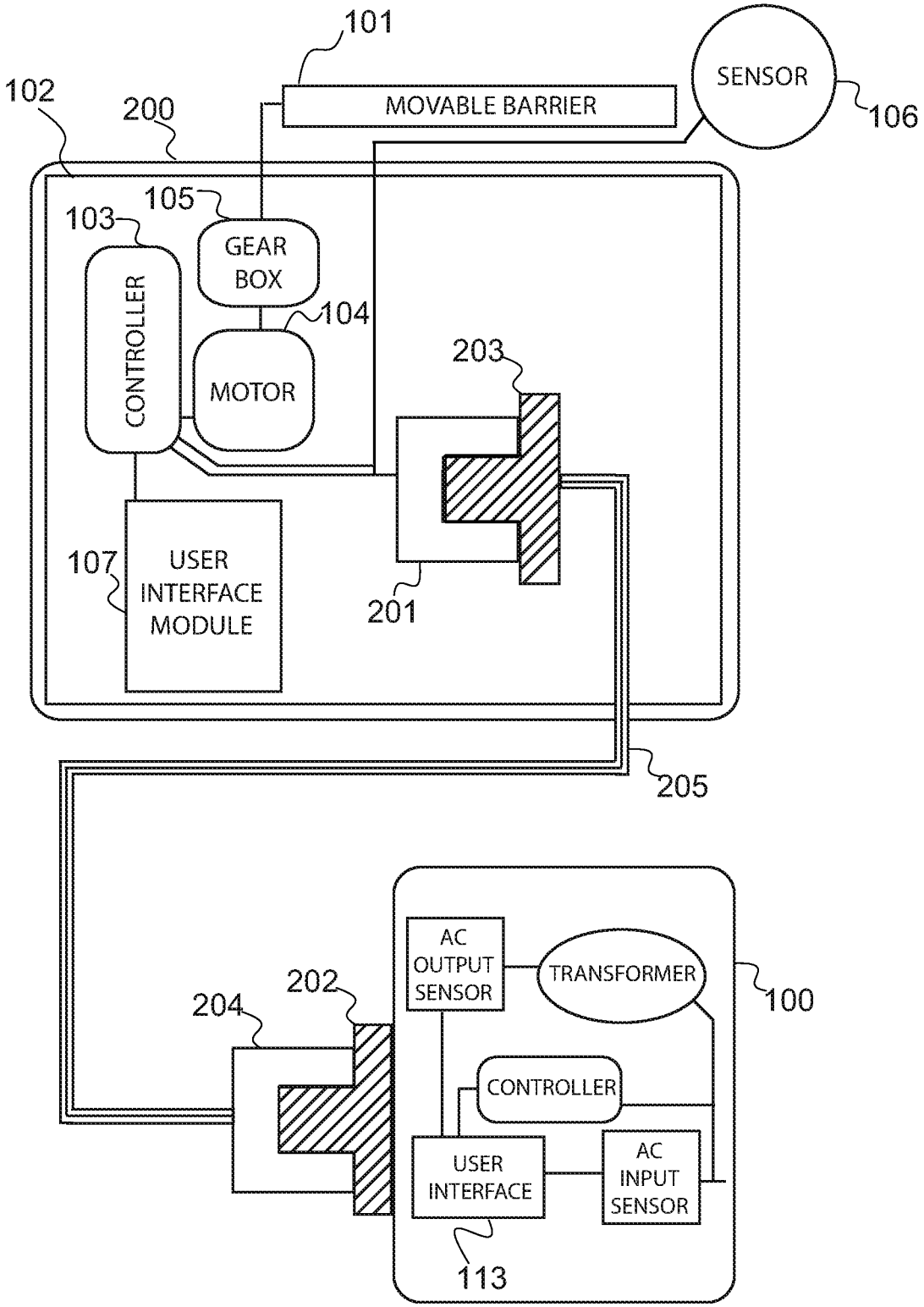

Turning to the next figure, FIG. 2(*a*) is a block diagram of a movable barrier operator in accordance with one embodiment of the present invention, the block diagram depicting the operator components when configured with a locally situated power supply module.

There may be situations in which installing module 100 housed with the other components of operator 102 is desirable. For such situations, module 100 may be coupled directly to operator 102 without requiring a cable.

In one embodiment, in which module 100 is housed within a housing or frame that supports the various components of operator 102, module 100 may be connected with one or more connectors. FIG. 2(*a*) shows operator 102, which is housed in a casing or housing 200. In this exemplary embodiment, housing 200 encloses the components of operator 102, which are configured to receive power from module 100 via a local connector 201. Connector 201 mates with connector 202, which is connected to module 100.

In such embodiment, module 100 is connected to an external power source such as a pre-installed high voltage power source, or a local power source to which module 100 can have easy access to.

Alternatively, FIG. 2(*b*) illustrates a block diagram depicting the operator components when configured with a remotely situated power supply module. In this figure, cable 205 is utilized to connect connectors 201 and 202 so that module 100 can supply power to operator 102. Additionally, as described above, cable 205 may transmit data or signals pertaining to diagnostic information or status information about operator 102.

Connectors 201, 202, 203, and 204, may be any type of connectors known in the art capable of enabling a power supply in addition to communicating data or signals between module 100 and operator 102. For example, and without limiting or deviating from the scope of the present invention, connectors 201, 202, 203, and 204, may be terminal connectors, posts connectors, plug and socket connectors, blade connectors, or any other type of connecter capable of providing operator 102 power and transmitting data or signals between operator 102 and module 100.

Cable 205 may typically comprise a low voltage power line. However, in other embodiments, cable 205 may comprise communication lines capable of transmitting signals. Hence, connectors 203 and 204 of cable 205 may be configured similarly depending on the capacities implemented into cable 205.

For example, and without deviating from the scope of the present invention, operator 102 may send a status signal through cable 205, and provide module 100 with an indication about various parameters relevant to a technician or service provider crew. Different information may be sent and received via cable 205 such as a power status related to operator 102, or information pertaining to a status regarding sensors 106 and barrier 101. Thus, the complexity of the data transmitted between the operator and module will depend on the complexity of module 100.

In one embodiment, only power diagnostics may be implemented and thus a signal relaying power supply information may be transmitted between module 100 and operator 102.

In other embodiments, the data received from module 100 may be general information about operator 102 or specific information about its current parameters. For example, and without limiting or deviating from the scope of the present invention, this information may comprise of limits of operation for the closed and opened position for barrier 101, time delays for automatic functions such as automatic closing of barrier 101, time delays after receiving commands from sensor 106, levels of sensitivity in detecting obstructions, voltage of operation, internal control voltages for different power supplies, and motor parameters such as speed and gate positions. Other parameters that may be communicated may include, without limitation, power line voltage, battery voltage, internal control board voltages, and instantaneous consumption currents for different devices that may be coupled to operator 102. As mentioned above, this information may be communicated to a user via user interface 113.

User interface 113 may be any type of user interface known in the art. For example, and without deviating or limiting the scope of the present invention, user interface 113 may comprise an analog interface, a digital interface, a graphical user interface, or any other type of user interface capable of adequately displaying the information being transmitted via cable 205. An exemplary embodiment of a user interface in accordance with the present invention is shown and described with reference to FIG. 3(*a*) and FIG. 3(*b*). In such embodiment, the user interface includes several LED indicators to provide information about the power supply module. As mentioned above, even if module 100 is locally installed within the operator, such as described with reference to FIG. 2(*a*), present a valuable advantage in that a technician does not need to pull voltmeters to determine the status of the power source, since it can rely on the LED indicators. Naturally, this is also true when the power supply is remotely situated.

Figure 3A:
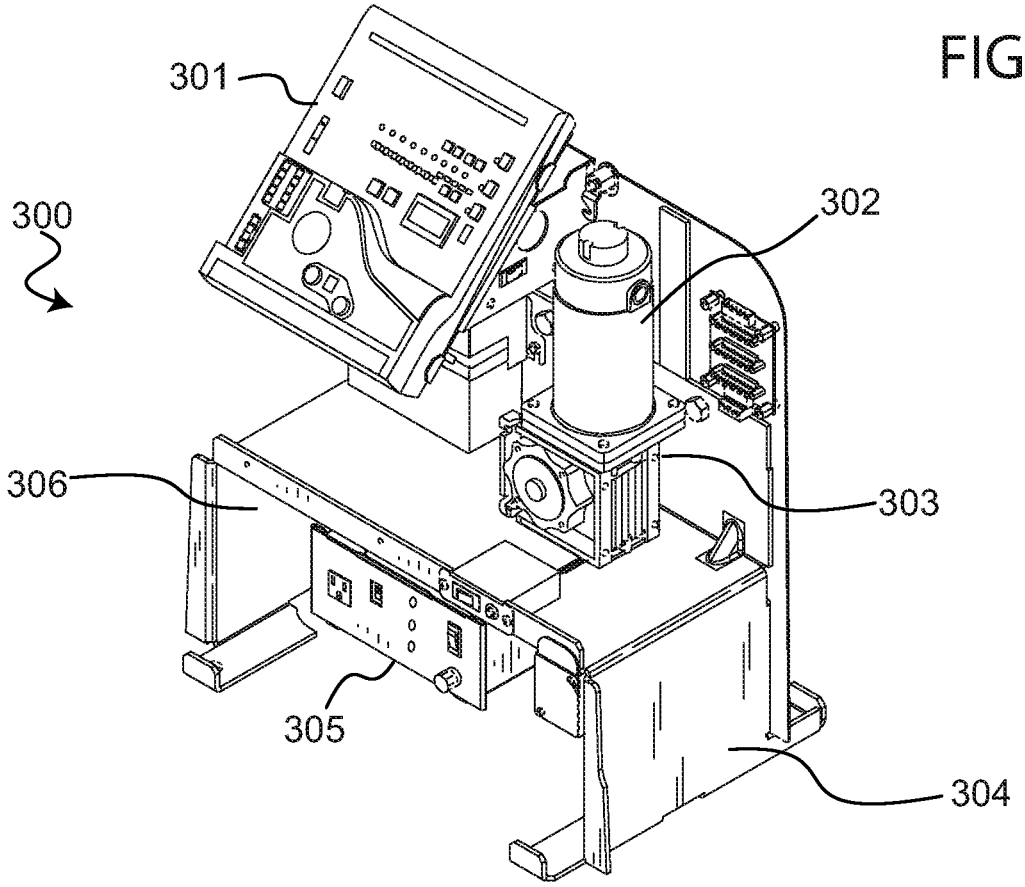
FIG. 3(*a*) is a perspective view of a movable barrier operator frame, in accordance with an exemplary embodiment of the present invention, wherein the removable power supply is housed within the frame's bay.
Figure 3B:
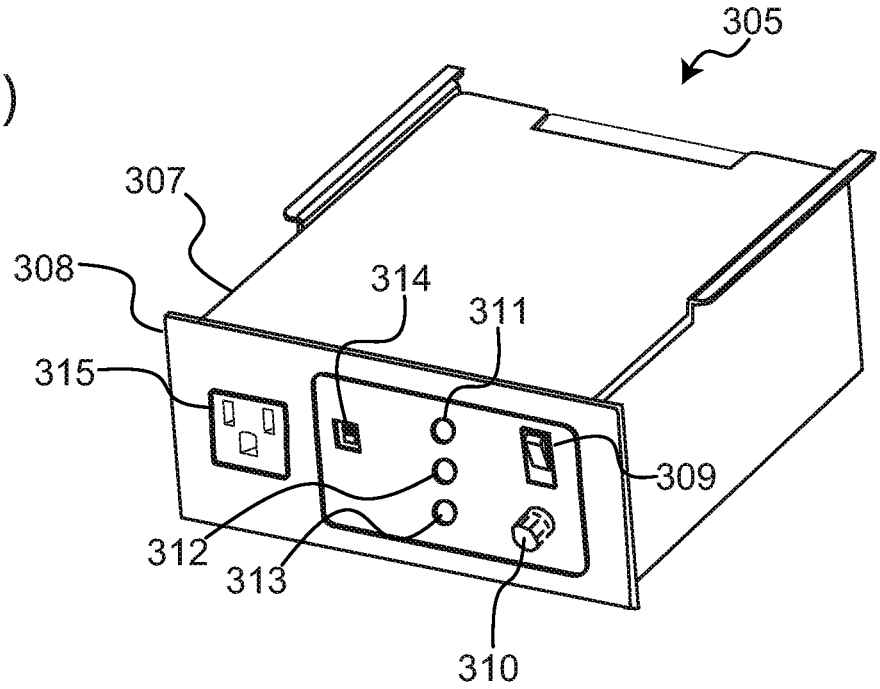

Turning to FIG. 3(*a*), a perspective view of a movable barrier operator frame is shown, in accordance with an exemplary embodiment of the present invention, wherein the removable power supply is housed within the frame's bay. More specifically, an L3™ chassis or frame for a movable barrier operator from Viking Access Systems® is shown, which has been retrofitted with a movable barrier operator that includes a removable power supply module, in accordance with an exemplary embodiment of the present invention.

Operator 300 is shown, comprising controller 301, motor 302, gear box 303, all coupled to the chassis or frame 304. Furthermore, operator 300 comprises power supply module (module 305), which is shown coupled to bay 306 of frame 304. In this configuration, no additional connecting cables are required; however module 305 must be housed within a housing for operator 300. In such situations, as explained above, a regular maintenance visit may require a technician to access the operator housing in order to glean any data pertaining to the status of the operator.

Alternatively, as explained above, module 305 may be installed remotely. When such configuration is desired, for example to avoid installation expenses associated with high voltage power line installations, module 305 may be placed at a remote location such as a maintenance shack or a guard hut. Using this remote configuration feature, operator 300 may be powered and diagnosed from the remote location at which the module is located. A maintenance crew or technician may glean information from module 305 simply by accessing its user interface. A close-up of module 305 is shown and discussed in reference to FIG. 3(*b*).

FIG. 3(*b*) is a perspective view of a removable power supply module, in accordance with an exemplary embodiment of the present invention, which includes a user interface comprising LEDs to indicate a status of the operator.

Module 305 comprises casing 307, which includes panel 308. As mentioned above, although module 305 may implement a wide variety of user interface types, in an exemplary embodiment, the user interface is a simple LED display on panel 308, as shown in FIG. 3(*b*).

Casing 307 may be any type of casing or housing that may used to support all the components of module 305. Typically, casing 307 may be constructed of any material and in any shape suitable to engage with bay 306 of operator 300. Hence, casing 307 should be configured so that it is removably coupled to bay 306 of frame 304.

Panel 308 further comprises power switch 309, fuse 310, AC voltage output indicator 311, surge protection indicator 312, AC voltage input indicator 313, voltage selector 314, and outlet 315. In this exemplary embodiment, AC voltage output indicator 311, surge protection indicator 312, and AC voltage input indicator 313 make up the entirety of a diagnostic LED display, and are each in turn LEDs that turn on or off depending on the signal that is generated and which pertains to a power supply status. However, in alternative embodiments, a digital display may be implemented that provides similar information to a user.

Thus, module 300 provides easy access to more than mere information. For example, module 300 provides a technician with easy access to a switch for switching between desired voltages, and to fuses, for changing a fuse from a remote location, which is advantageous over having to interfere with the operation of a movable barrier in the event maintenance is required.

Additionally, other information may be displayed depending on the capabilities desired. For example, and without limiting or deviating from the scope of the present invention, panel 308 may provide more detailed diagnostic information such as limits of operation for the close and opened position for a barrier mechanically connected to operator 300, time delays for automatic functions such as automatic closing of the barrier, time delays after receiving commands from sensor, levels of sensitivity in detecting obstructions, voltage of operation, internal control voltages for different power supplies, and motor parameters such as speed and gate positions, power line voltage, battery voltage, internal control board voltages, and instantaneous consumption currents for different devices that may be coupled to operator 300.

In the exemplary embodiment shown, for each of the enumerated LED indicators, a lit LED may indicate the corresponding task is being properly and adequately carried out. Conversely, an unlit LED may indicate the corresponding task is not being properly or adequately carried out.

Power switch 309 is generally any input device that allows for users to turn module 305 on/off and supply power to operator 300. Hence, power switch 309 may be any type of suitable switch known in the art. Similarly, fuse 310 is a safety feature known in the art and common with power supply modules for devices such as movable barrier operators.

AC voltage output 311 may be an LED indicator which informs a user, such as a maintenance technician, of the status of power being drawn into module 305 from a power source. Surge protection indicator 312 may be an LED indicator which informs an observer if module 305 is properly protecting against sudden surges in electrical voltage. As with known surge protectors, surge protection indicator 312 limits the voltage that is supplied to module 305 by a power source either by rejecting excess voltages or by diverting them into the ground. Again, these components are known and common in the art.

AC voltage input 313 may be an LED indicator which informs an observer of the status of power being sent to operator 300 from module 305 via a cable such as cable 205. Thus, by way of example: when AC voltage input 313 is lit, power module 305 may indicate that it is working properly and adequately giving power to operator 300. Conversely, if AC voltage input 313 indicates otherwise, module 305 can inform a user that either maintenance on the device is due, or that repairs may be required. For instance, if a connector is not properly attached between module and operator or the power supply is not able to draw power from a faulty power source.

Voltage selector 314 may be a switch which allows for module 305 to switch between two different voltages, depending on the chosen setting. In an exemplary embodiment, the two voltages voltage selector 314 allows a user to select between 120 volts and 220 volts. Naturally, transformation between the lower and higher voltages is accomplished via a transformer such as transformer 112, for example a toroidal transformer.

Outlet 315 may be any outlet for connecting a device to module 305. Outlet 315 may be designed to receive any type of standard connection, whereof the designs would be known or easily attainable by a person of ordinary skill in the art.

In other embodiments, module 305 may have a component configured to receive a USB device. For example, module 305 may be configured to receive both a USB device and a standard three-pronged cord. Outlet 307 may be used, for instance, to receive a connection to a diagnostic kit, whereby diagnostic information more advanced than the basic incoming and outgoing power supply and surge protection information may be acquired.

A movable barrier operator with a removable power supply module has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. A movable barrier operator, comprising:

a controller configured to generate a control signal to control activation of a motor;

a frame mechanically supporting the motor, a gearbox, and the controller, wherein the frame comprises a bay including a first connector;

a removable power supply module, comprising a housing including protrusions situated at a top surface of the housing configured to removably engage with the bay of the frame, the housing including a second connector configured to mate with the first connector directly or using a removable cable, wherein the removable power supply module is configured to draw AC power from an AC power source, and supply DC power to the controller through the mated first and second connectors, the removable power supply module including:

a panel providing a user interface on a front face of the housing;

a transformer enclosed within the housing;

sensors enclosed within the housing providing a user with a status regarding the movable barrier operator; and a power switch, a fuse access, a power outlet, and a voltage selector situated on a front surface of the panel; and a movable barrier operator housing enclosing the controller, the frame, and the removable power supply of the movable barrier operator.

2. The movable barrier operator of claim 1, wherein the panel further includes an LED indicator.

3. The movable barrier operator of claim 2, wherein the LED indicator includes an AC voltage output indicator.

4. The movable barrier operator of claim 2, wherein the LED indicator includes an AC voltage input indicator.

5. The movable barrier operator of claim 2, wherein the LED indicator includes surge protection indicator.

6. A movable barrier operator, comprising:

a controller configured to generate a control signal to control activation of a motor;

a frame mechanically supporting the motor, a gearbox, and the controller, wherein the frame comprises a bay including a first connector;

a removable power supply module, comprising a power supply housing including protrusions situated at a top surface of the power supply housing configured to removably engage with the bay of the frame, the power supply housing including a second connector configured to mate with the first connector directly or using a removable cable, wherein the removable power supply module is configured to draw AC power from an AC power source, and supply DC power to the controller through the mated first and second connectors, the removable power supply module including:

a panel providing a user interface of the removable power supply;

a transformer enclosed within the power supply housing;

a power switch situated on a surface of the panel; and a power outlet; and a movable barrier operator housing enclosing the controller, the frame, and the removable power supply of the movable barrier operator.

7. The movable barrier operator of claim 6, wherein the panel further includes sensors enclosed within the power supply housing for providing a user with a status regarding the movable barrier operator.

8. The movable barrier operator of claim 6, wherein the panel further includes a fuse access situated on a surface of the panel.

9. The movable barrier operator of claim 6, wherein the panel further includes a power outlet situated on a surface of the panel.

10. The movable barrier operator of claim 6, wherein the panel further includes a voltage selector situated on a surface of the panel.

11. The movable barrier operator of claim 6, wherein the panel further includes an LED indicator.

12. A movable barrier operator, comprising:

a controller configured to generate a control signal to control activation of a motor;

a frame mechanically supporting the motor, a gearbox, and the controller, wherein the frame comprises a bay including a first connector;

a removable power supply module, comprising a power supply housing including protrusions situated at a top surface of the power supply housing configured to removably engage with the bay of the frame, the power supply housing including a second connector configured to mate with the first connector directly or using a removable cable, wherein the removable power supply module is configured to draw AC power from an AC power source, and supply DC power to the controller through the mated first and second connectors, the removable power supply module including:

a panel providing a user interface of the removable power supply;

a transformer enclosed within the power supply housing;

sensors enclosed within the power supply housing providing a user with a status regarding the movable barrier operator; and a movable barrier operator housing enclosing the controller, the frame, and the removable power supply of the movable barrier operator.

13. The movable barrier operator of claim 12, wherein the panel further includes a power switch, a fuse access, and a voltage selector situated on a front surface of the panel.

14. The movable barrier operator of claim 12, wherein the panel further includes a power outlet situated on a surface of the panel.

15. The movable barrier operator of claim 12, wherein the panel further includes an LED indicator.

* * * * *